US006156083A

United States Patent [19]

Dial

[11] Patent Number: 6,156,083

[45] Date of Patent: Dec. 5, 2000

[54] COAL RECLAMATION SYSTEMS

[75] Inventor: James R. Dial, Willis, Tex.

[73] Assignee: Tuboscope, Houston, Tex.

[21] Appl. No.: 09/019,006

[22] Filed: Feb. 5, 1998

[51] Int. Cl.[7] ..... C10L 5/02; C10L 9/00

[52] U.S. Cl. ..... 44/596; 44/550; 44/594; 44/621; 44/626; 209/10; 209/12.1; 209/13; 209/17; 209/18; 209/157; 209/158; 209/208; 209/725

[58] Field of Search ..... 44/594, 550, 596, 44/621, 626; 209/10, 12.1, 13, 17, 18, 157, 158, 208, 725

[56] References Cited

U.S. PATENT DOCUMENTS

| | | | |
|---|---|---|---|
| 500,302 | 6/1893 | Stoeckel et al. . | |
| 984,866 | 2/1911 | Tate . | |
| 2,138,825 | 12/1938 | Allen | 44/621 |
| 3,579,442 | 5/1971 | Gerwig | 44/621 |
| 4,000,074 | 12/1976 | Evans | 210/369 |
| 4,101,263 | 7/1978 | Lumpkin, Jr. | 432/13 |
| 4,130,945 | 12/1978 | Brachtauser | 34/10 |
| 4,146,366 | 3/1979 | Keller | 44/621 |
| 4,244,530 | 1/1981 | Halvorsen | 44/621 |
| 4,365,741 | 12/1982 | Greer et al. | 44/621 |
| 4,455,148 | 6/1984 | Nagata et al. | 44/621 |
| 4,541,933 | 9/1985 | Armold | 210/780 |
| 4,565,015 | 1/1986 | Hundley, III | 34/182 |
| 4,594,793 | 6/1986 | Carlson | 34/10 |
| 4,619,669 | 10/1986 | Jones et al. | 44/621 |
| 4,795,037 | 1/1989 | Rich, Jr. | 44/621 |
| 4,961,722 | 10/1990 | Taylor et al. | 494/36 |
| 5,124,049 | 6/1992 | Maness | 210/715 |
| 5,330,643 | 7/1994 | Webb et al. | 210/255 |
| 5,413,709 | 5/1995 | Webb et al. | 210/255 |
| 5,458,786 | 10/1995 | Yoon et al. | 44/626 |
| 5,561,916 | 10/1996 | Willgohs | 34/363 |
| 5,604,994 | 2/1997 | Annen et al. | 34/314 |
| 5,614,094 | 3/1997 | Diester et al. | 210/388 |
| 5,641,071 | 6/1997 | Read et al. | 209/319 |
| 5,643,169 | 7/1997 | Leung et al. | 494/53 |
| 5,676,710 | 10/1997 | Chedgy | 44/621 |
| 5,771,601 | 6/1998 | Veal et al. | 34/314 |

OTHER PUBLICATIONS

"Tuboscope Is Your Single Resource for Best–In–Class Oilfield Services", Tuboscope, 1997. Month Unknown.

"Sweco Oilfield Services, A Division of Environmental Procedures, Inc.," Environmental Procedures, Inc., 1995. Month Unknown.

"Separation Through Technology—Composite Catalog," Brandt EPI, Feb. 1996. Month Unknown.

"Fluid Processing Equipment For the Drilling & Environmental Industries," Tri–Flo Int'l Inc., 1996. Month Unknown.

"Pressure Control Solids Control Rig Instrumentation," Swaco Geolograph, Dec. 1993. Month Unknown.

*Primary Examiner*—Margaret Medley

*Attorney, Agent, or Firm*—Finnegan, Henderson, Farabow, Garrett & Dunner, L.L.P.

[57] ABSTRACT

A method for recovering coal from a mixture containing fine particles of coal, the mixture including fine coal particles, water, and impurities, the method including feeding the mixture to a first liquid/solid separator that removes relatively large pieces of material from the mixture producing a first stream containing recoverable fine coal particles, and pumping the first stream from the first liquid/solid separator to at least one second liquid/solid separator, the at least one second liquid/solid separator separating recoverable fine coal particles from the first stream producing a product flow containing fine coal particles and a discharge stream containing, e.g., water and impurities. In one aspect, the coal in the product flow is then dried and/or pelletized. In one aspect fine coal particles in the product flow have a largest dimension of less than 100 microns. In one aspect, fine coal particles in the product flow have a largest dimension of at least about 40 microns.

18 Claims, 2 Drawing Sheets

COAL RECLAMATION SYSTEMS

BACKGROUND OF THE INVENTION

1. Field of the Invention

This invention is directed to systems and method for the reclamation of usable coal from mixtures containing coal and other substances and, in one particular aspect, to recovering relatively fine coal particles from accumulations of material containing fine coal, ash, pyrites and other impurities.

2. Description of Related Art

For many years the processing of mined coal resulted in the creation of large accumulations or "ponds" of process byproducts that included, among other materials, much coal that was present in small particles that were considered to be too small for use and/or too small to practically recover by further processing.

These ponds contain fine coal, ash, pyrites and other impurities. Heretofore, recovery of very fine coal particles, e.g. but not limited to particles smaller than 100 mesh (150 microns or smaller in a largest dimension), has not been pursued on a large scale. Consequently, much coal that could be used as fuel has not been recovered.

There has long been a need for an effective and efficient system and method for recovering fine coal from material accumulations. There has long been a need for such systems and methods with which such coal is separated from ash, pyrites and other impurities. There has long been a need for such a system that is economically feasible and environmentally friendly.

SUMMARY OF THE PRESENT INVENTION

The present invention, in certain aspects, teaches a system for treating material containing fine coal and impurities to separate out the fine coal so that it is usable as fuel. In one aspect such a system includes: a first liquid/solid separator to which is fed an input aqueous stream containing fine coal to be recovered and impurities; a second liquid/solid separator that receives a treated stream with certain relatively large pieces removed from the first liquid/solid separator; a conveyor system that receives the dewatered coal stream from the second liquid/solid separator and conveys it to a dryer from which recovered coal is fed to an exit conveyor system for transmission to suitable containers. In one aspect a scrubber may be used in conjunction with the dryer. In one aspect the recovered coal is pelletized. Suitable pumps, valves and controls are used with the various apparatuses and on flow lines interconnecting the various apparatuses.

In one aspect the first liquid/solid separator is any known suitable apparatus, device, or system that will remove undesirable pieces of material with a certain largest dimension from the input aqueous stream. In one particular aspect, a patented Brandt Hydratower™ system is used which removes pieces with a largest dimension of one half, three eighths, or one Fourth of an inch and pieces larger than this from the input aqueous stream.

In one aspect the second liquid/solid separator is any suitable known vibrating screen or shaker system. In one particular aspect the second liquid/solid separator is a known Brandt SDW-25™ system vibratory screen separator which has an initial auxiliary separator, e.g. a hydrocyclone, which makes an initial separation of fine solids, including fine coal, from the material received from the first liquid/solid separator. The hydrocyclones desired output ("unders" from the bottom of the hydrocyclone) flow to a dewatering deck of the SDW-25 System. High speed motion of the dewatering deck further purifies and dewaters the particles which move down and then off of the dewatering deck through a discharge while undesirable materials flow through the systems' mesh screens (in one aspect assisted by a water spray).

These recoverable fine coal particle solids flow to the conveyor system for transport to the dryer. The "overs" from the hydrocyclones are discharged from the system or, alternatively, flow into collection tanks beneath an SDW-25 systems. A stream with undesirable materials containing liquid and solids flows to the collection tank below the SDW-25 System. This stream and/or the "overs" can be recycled for further treatment in the system or discharged as waste.

In one aspect a plurality of second liquid/solid separators are used. In one particular aspect a series of second and additional separations, one feeding the other, progressively removes finer and finer recoverable particles of coal.

In another aspect of such a system with such a series of separators, the discharge from one, some or all of them that includes liquid and solids is fed to one or more third liquid/solid separators to recover even more recoverable coal. In one aspect, the third separators are a bank of known SE-20 four inch hydrocyclones commercially available from Brandt Company. These third separator(s) produce slurry stream(s) with recoverable coal therein ("unders" from the hydrocyclone) in one aspect, by gravity to a tank, e.g. but not limited to, a known cone tank. Recovered coal in a slurry is pumped from the cone tank. The slurry is pumped to one of the second liquid/solid separators.

Alternatively, one or more positive displacement pumps pumps the stream with recoverable coal therein from the cone tank to one or more centrifuges which separate the recoverable coal from a dischargeable effluent.

In one aspect the input aqueous stream is produced by a dredge system with a dredge which gathers material from a pond and a water pumping system that provides water to the dredge. In one aspect, additional water is added to the dredge's output. Alternatively material is gathered from a pond with any known tool and/or machine and transported to and/or pumped to the first liquid/solid separator.

In certain aspects the present invention provides systems and methods of their use which result in the recovery of coal particles smaller than 100 microns and, in one particular aspect, as small as about 40 microns in a largest dimension.

It is, therefore, an object of at least certain preferred embodiments of the present invention to provide:

New, useful, unique, efficient, nonobvious systems and methods for recovering fine coal particles from mixtures and/or aqueous streams containing them;

Such systems and methods with which fine coal particles smaller than 100 microns in a largest dimension are recovered, and, in one aspect as small as about 40 microns;

Such systems and methods with which pyrites, ash, sulfur and other impurities are separated from recoverable fine coal particles; and Such systems and methods in which recovered fine coal is pelletized to produce useful coal pellets, and, in one aspect combined with larger pieces of coal to form pellets.

Certain embodiments of this invention are not limited to any particular individual feature disclosed here, but include combinations of them distinguished from the prior art in their structures and functions. Features of the invention have been broadly described so that the detailed descriptions that follow may be better understood, and in order that the contributions of this invention to the arts may be better appreciated. There are, of course, additional aspects of the invention described below and which may be included in the subject matter of the claims to this invention. Those skilled in the art who have the benefit of this invention, its teachings, and suggestions will appreciate that the conceptions of this disclosure may be used as a creative basis for designing other structures, methods and systems for carrying out and practicing the present invention. The claims of this invention are to be read to include any legally equivalent devices or methods which do not depart from the spirit and scope of the present invention.

The present invention recognizes and addresses the previously-mentioned problems and long-felt needs and provides a solution to those problems and a satisfactory meeting of those needs in its various possible embodiments and equivalents thereof. To one skilled in this art who has the benefits of this invention's realizations, teachings, disclosures, and suggestions, other purposes and advantages will be appreciated from the following description of preferred embodiments, given for the purpose of disclosure, when taken in conjunction with the accompanying drawings. The detail in these descriptions is not intended to thwart this patent's object to claim this invention no matter how others may later disguise it by variations in form or additions of further improvements.

DESCRIPTION OF THE DRAWINGS

A more particular description of embodiments of the invention briefly summarized above may be had by references to the embodiments which are shown in the drawings which form a part of this specification. These drawings illustrate certain preferred embodiments and are not to be used to improperly limit the scope of the invention which may have other equally effective or legally equivalent embodiments.

DESCRIPTION OF EMBODIMENTS PREFERRED AT THE TIME OF FILING FOR THIS PATENT

Figure 1:
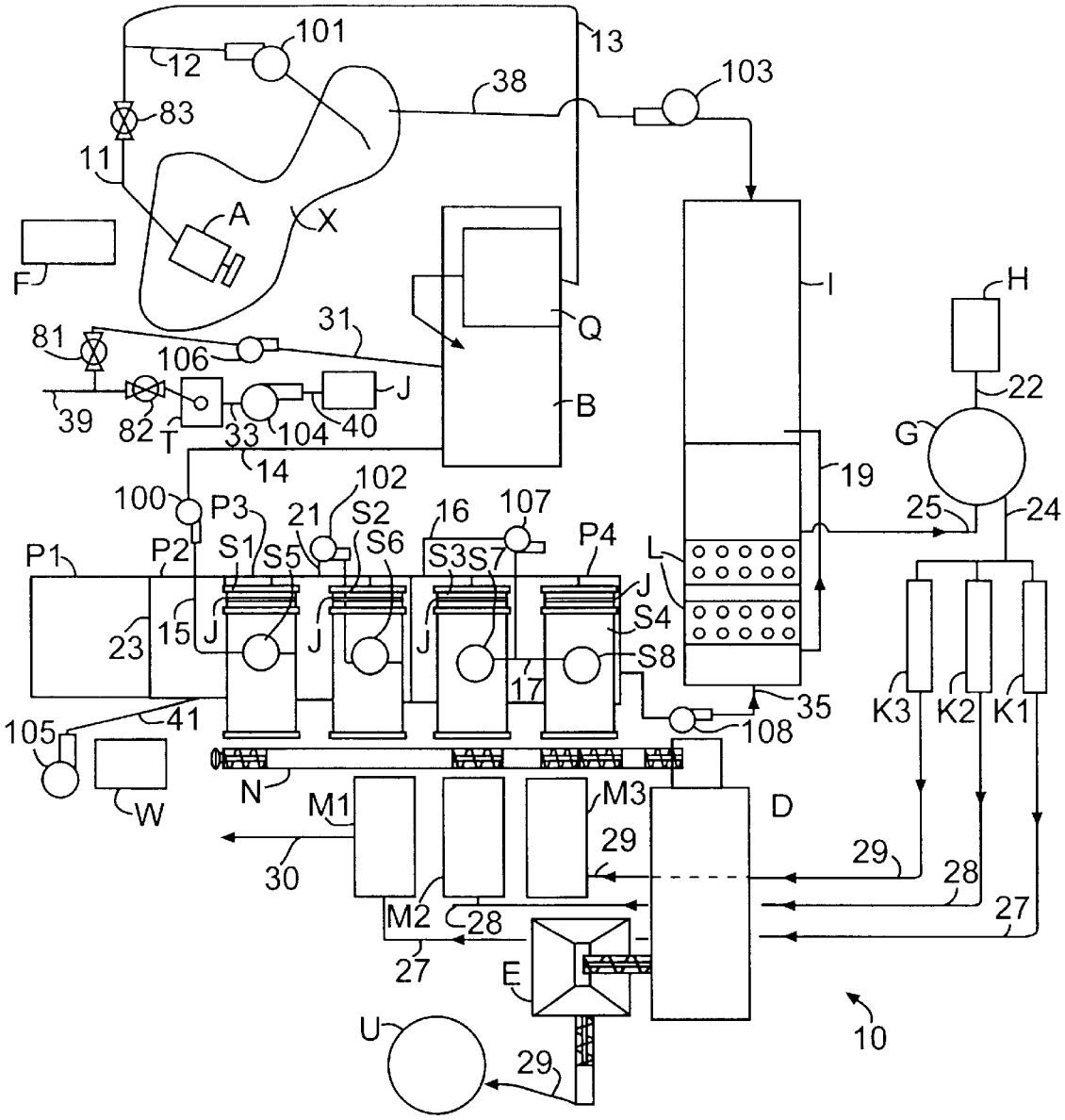
FIG. 1 is a schematic view of a system according to the present invention.

FIG. 1 presents a system 10 according to the present invention that includes a dredge A that operates in a pond X of a mixture of water and recoverable fine coal particles and other materials including, e.g. undesirable ash, pyrites and other impurities such as sulfur. In one aspect the dredge is a commercially available cable operated VMI Co. dredge with a fifteen foot reach with a diesel powered pump and hydraulic controls. Additional water may be pumped as needed to the pond. A fuel tank F contains fuel for the dredge A. Dredged pond material and water flows, e.g. at about 1,000 gallons per minute, from the dredge A in a flow line 11 to a flow line 13 (e.g. a stream between about 60 to 65% recoverable coal particles by weight, the remainder water and impurities) and then to a first liquid/solid separator Q. A check valve 83 controls flow in line 11 and prevents back flow in the line 11 to the pond X. Additional water from a near or remote water source e.g. another 500 gallons per minute, may be pumped by a pump B in a flow line 12 into the flow line 13. Alternatively additional water is pumped from the pond if available.

The first liquid/solid separator Q treats the stream from the flow line 13 preferably removing material pieces with a largest dimension of ⅜" or bigger. The first liquid/solid separator produces a coal-rich slurry including water, recoverable fine coal particles, ash, pyrites and sulfur that flows to an agitating tank B. Additional water from a water supply line 39 pumped in a line 31 may be pumped to the tank B by a pump 106. A valve 81 controls flow in the line 31. A resulting stream from the agitator tank B in a line 14 is pumped by a pump 100 in a line 15 to an auxiliary separator S5 of a first separator S1 of a series of second liquid/solid separators S1, S2, S3, and S4 (e.g. Brandt SDW-25 systems with screens). In one aspect the desirable material moving down the screens of the separators S1–S4 to a conveyor system N has less than 15% impurities by weight and less than 17% moisture by weight, the remainder recoverable fine coal particles. Each second liquid/solid separator S1, S2, S3, end S4 has associated therewith an auxiliary liquid/solid separator S5, S6, S7, and S8, respectively. In certain aspects, the first liquid/solid separator may be one as disclosed in either U.S. Pat. No. 5,330,643 or U.S. Pat. No. 5,413,709, both of which are incorporated herein in their entirety for all purposes.

In one aspect of a system according to the present invention, the auxiliary liquid/solid separator S5 is a hydrocyclone capable of removing particles, including coal particles, ranging in size between ⅜" (largest dimension) and about 710 microns (largest dimension). In one particular aspect, the hydrocyclone used is a commercially available Brandt/EPI Tm Vacuum Assisted Cyclone or "VAC" with an 18" cone. A stream (coal rich "unders" from the VAC) containing the ⅜" to 710 micron particles (including i.e. coal particles) flows onto a screen deck of the separator S1. Liquid and undesirable materials flow through the screens of the separator S1 as the desirable recoverable fine coal particles flow down the screens to a conveyor system N. The material flowing through the screens flows into a tank P2 below the separator S1 from which it is pumped by a pump 102 in a line 21 to the separator S6. The separator S6 is, in one aspect, a hydrocyclone with a 12" cone, e.g. a commercially available Brandt Co. SR-3 hydrocyclone that separates out recoverable coal particles in the size range (largest dimension) of less than 710 microns to about 74 microns. The stream with such particles (coal-rich "unders" from the hydrocyclone) flows to and then down screens of the separator S2 to the conveyor system N; and undesirable material flows through the screens to a tank P3 from which it is then pumped by a pump 107 in lines 16, 17 to the separators S7 and S8. Each separator S7 and S8 has a 4" cone and separates out recoverable coal particles in the size range of less than 74 microns to about 40 microns (in one aspect as small as 38 microns). The recoverable fine coal particles flow down the screens of the separators S3 and S4 to the conveyor system N.

The conveyor system N conveys materials to a dryer D, e.g. a model EB-26 Modified Dryer commercially available from Centrifugal Services, Inc. The dryer D removes moisture (in certain aspects, up to 14%) from the material and conveys a dried fine coal product to an exit conveyor system E. In one aspect the feed to the dryer is about 75% recoverable fine coal particles and about 25% moisture. Optionally, pelletizer U (any suitable known pelletizer) receives recovered fine coal from the system E and produces useful coal pellets. In one aspect, the pellets include the recovered coal and larger pieces of coal from another source.

The material in the tanks P4 may be pumped from the system 10 as waste or it may be processed further to recover additional fine coal particles. In the system 10 as shown the "unders" from the separators S3 and S4 in the tank P4 beneath the separators are pumped by a pump 108 in a line 35 to a secondary separation system. Initially these "unders" are fed to one or more hydrocyclones L, e.g. commercially available Brandt Co. SE-20 four inch cone hydrocyclones (used, in one aspect, in a bank of a plurality, e.g. 20 hydrocyclones) which produce a discharge stream 19 with liquid (primarily water and impurities) which flows to tank I and is then pumped in a line 38 by a pump 103 back to the pond X. A stream from the separators L with recoverable fine coal therein flows by gravity in a line 25 to a storage tank G, e.g. a holding area, an isolated part of pond X, or a typical cone tank such as (but not limited to) those commercially available from Brandt Company. A stream 24 containing water and recoverable coal particles (preferably the stream 24 is at least 25% by weight coal, the remainder primarily water) is pumped, e.g. by one or more positive displacement pumps, pumps K1, K2, and K3, in lines 27, 28, 29, respectively to third liquid/solid separators M1, M2, and M3. In one aspect the third liquid/solid separators are centrifuges, e.g. but not limited to, commercially available Model #53400 centrifuges commercially available from Brandt Company which help dewater recoverable coal from the lines 27–29. The separators M1, M2, and M3 produce an effluent which flows for disposal from the system 10 in a flow line 30. The separators M1, M2 and M3 also produce a flow of recovered coal particles (e.g. in one aspect, in a size range between about 40 and about 70 microns) that flows to the conveyor system N.

To facilitate handling of recoverable fine coal particles from the tank G, a flocculant may be added by a flocculating system H which feeds known flocculants, including known flocculants such as polymers at a known rate, e.g. but not limited to about 20 parts per million to the third liquid/solid separator G in a flow line 22.

In one aspect a water spray bar system J is provided for each separator S1–S4. This water is pumped from a water supply line 39 from a tank T through a line 33 by a pump 104 in a line 40 to the spray bar systems J [shown as a box at the end of line 40 in FIG. 1 and labelled as J on the separators S1–S4], e.g. at about 200 gallons per minute. Water is provided in a flow line 31 to the is tank B. If desired, water from the tank B may also be pumped to the tank T. Valves 81, 82 control flow in :he lines 31 and 32, respectively. Other pumps, valves and/or flow controllers may be used on any line in the system 10 as appropriate.

In one aspect, additional water is provided from a water source W and pumped in a line 41 by a pump 105 to the tank P2. Tanks P1 and P2 intercommunicate e.g. via an opening or openings in a lower portion of a common wall 23 therebetween. The tank P2 underlies only the separator S1 and receives the "overs" from the auxiliary separator S5 and the flow through the screens of the separator S1. The tank P3 underlies only the separator S2 and receives both the "overs" from the auxiliary separator S6 and the flow through the screens of the separator S2. The tank P4 underlies both the Separators S3 and S4 and receives the "overs" from the auxiliary separators S7 and S8.

Recovered coal is, optionally, sent from the conveyor E in a line 29 to a pelletizer U (any suitable known pelletizer) for making into useful pellets. Additional coal, including but not limited to pieces of coal larger than those recovered by the system 10, can, according to this invention, be combined with the recovered fine coal particles and made into pellets.

The screens of the separators S1–S4 may be any desired mesh. In one aspect, the screens are all 200 mesh. In one aspect the meshes are selected so that each successive separator removes smaller and smaller coal particles (i.e., they are maintained on top of the screens and flow to the conveyor) In one aspect the screens on the separators S1–S4 have the following mesh sizes, respectively: S1, 24 mesh; S2, 80 mesh; S3, 140 mesh; S4, 175 mesh; and thus each successive separator removes smaller and smaller coal particles.

Figure 2:
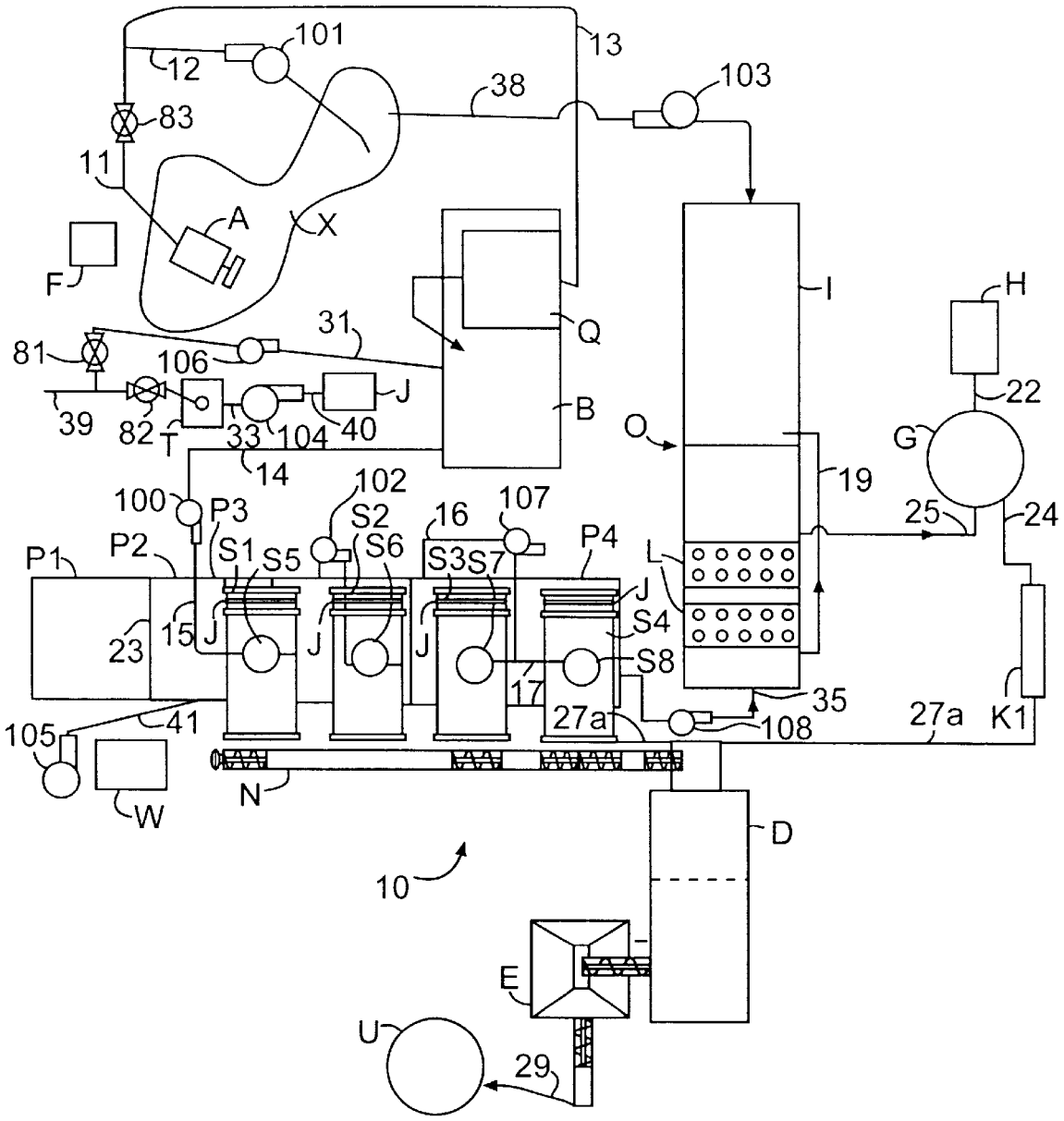
FIG. 2 is a schematic view of an alternative part of the system of FIG. 1.

As shown in FIG. 2, in an alternative of the system 10, the fourth separators M1–M3 are deleted as are the pumps K2 and K3. The pump K1 pumps the stream with recovered coal particles from the separator G to one of the separators S1–S4, in this case to the separator S4 via a flow line 27*a*. In certain aspects each or any tank herein containing process streams and/or materials is an agitating tank such as, but not limited to, a commercially available 750 barrel tank from Brandt Company with known agitator(s) therein.

In one aspect the input stream in line 13 flows at a rate of about 99 tons of material per hour from the pond (not including the water) and the system produces about 50 tons per hour of recovered fine coal particles from such an input stream in line 13 (about 99 tons that is about 60 to 65% recoverable fine coal particles by weight). In such a system of about 66 tons per hour of material processed by the separators S1–S4, about 50 tons of coal flows to the conveyor system for drying from these separators with a dryness, preferably, of between 40% to 60%. Also, due to a "piggyback" effect on top of the screens of the SDW-25 systems, an accummulated mass of recoverable coal on top of a screen acts as a filter through which liquid can flow (and then flow down through the screen with impurities) while the coal mass itself maintains thereon and/or therein particles which are small enough to pass through the screens, but are prevented from doing so by the coal mass.

Submitted with the application for this patent in an appendix hereto are the following brochures of the Brandt Company: "Hydratower," 1995; "Brandt Mud Agitators," 1995; "Brandt Hydrocyclones," 1996. Submitted with the application for this patent in am appendix hereto are the following brochures of Brandt/EPI: "HS-3400 Decanting Centrifuge," 1996; "SDW-25 System," 1995; "Vacuum Assisted Cyclone Separator," 1996. All of these brochures are incorporated fully herein in their entirety for all purposes.

It is seen, therefore, that the present invention provdides, in certain embodiments a method for recovering coal from a mixture containing fine particles of coal, the mixture including fine coal particles, water, and impurities, the method including feeding the mixture to a first liquid/solid separator that removes from the mixture pieces of material exceeding a specified lower size limit (e.g., but not limited to pieces with a largest dimension of a half inch or three-eights of an inch) from the mixture and produces a first stream containing water, impurities, and recoverable fine coal particles, and pumping the first stream from the first liquid/solid separator to at least one second liquid/solid separator, the at least one second liquid solid separator separating recoverable fine coal particles from the first stream producing a product flow containing fine coal particles and a discharge stream containing water and impurities; such a method including conveying the product flow to a dryer and producing with the dryer dried recovered fine coal particles; any such method including pelletizing the recovered fine coal particles (alone or with other coal particles and/or pieces and/or with other fuel material) to form useful pellets; any such method including adding gross coal pieces to the recovered fine coal particles and forming pellets containing gross coal pieces and recovered fine coal particles; any such method wherein the fine coal particles in the product flow have a largest dimension of less than 100 microns; any such method wherein the fine coal particles in the product flow have a largest dimension of at least 38 microns or at least about 40 microns; any such method including flowing the discharge stream from the at least one second liquid/solid separator to at least one third liquid/solid separator and therein separating recoverable fine coal particles from the discharge stream producing a third stream with recoverable fine coal particles therein; any such method including flowing the third stream to at least one fourth liquid/solid separator producing a fourth stream with recoverable fine coal particles therein, and then conveying the fourth stream to a dryer and producing with the dryer recovered fine coal particles; any such method inlcuding, prior to pumping the first stream to the at least one second liquid/solid separator, flowing the first stream to at least one auxiliary liquid/solid separator producing a stream with recoverable fine coal particles therein and a stream for discharge to a collection tank; any such method wherein the first liquid/solid separator removes pieces of material from the mixture that have a largest dimension of at least a half or three-eights or one fourth of an inch; any such method wherein the first liquid/solid separator includes a downwardly inclined separator screen assembly with at least one screen over which the mixture flows so that pieces of material in the mixture with a largest dimension larger than a size of openings in the at least one screen are segregated on a top surface of screen and therby prevented from flowing to the at least one second separator; any such method wherein the at least one screen is has separate upper and lower sections each of which is separately adjustable with respect to vertical; any such method wherein the at least one second liquid/solid separator is a vibratory screen shaker apparatus and, in one aspect,a Brandt SWD-25 system;any such method wherein the at least one third liquid/solid separator is a hydrocyclone; any such method wherein the at least one fourth liquid/solid separator is a centrifuge; any such method wherein the at least one auxiliary liquid/solid separator is a hydrocyclone or a vacuum assisted hydrocyclone; any such method wherein the at least one auxiliary liquid/solid separator is a plurality of auxiliary separators including a first and second auxiliary separator and the at least one second liquid/solid separator is a plurality of second liquid/solid separators including primary and secondary second liquid/solid separators, the method further including producing a first coal-rich stream with the first auxiliary separator from the first stream from the first liquid/solid separator, feeding the first coal-rich stream to the primary second liquid/solid separator and producing therewith a flow of recoverable fine coal particles and a first discharge flow containing water, impurities, and recoverable fine coal particles, and feeding the first discharge flow to the second auxiliary separator producing therewith a second coal-rich stream that flows to the secondary second liquid/solid separator and producing therewith a flow of recoverable fine coal particles and a second discharge flow containing water, impurities, and recoverable fine coal particles, and, in certain aspects, repeating this with one, two, three or more additional auxiliary separators and one, two, three or more additional second liquid/solid separators. The present invention provides a pellet made by any method described or disclosed herein. The present invention provides a recovered fine coal particle produced by the any method described or disclosed herein.

In conclusion, therefore, it is seen that the present invention and its embodiments are well adapted to carry out the objectives set forth. Changes are possible within the scope of this invention and it is further intended that each element or step recited in any of the following claims is to be understood as referring to all equivalent elements or steps. The following claims are intended to cover the invention as broadly as legally possible in whatever form it may be utilized. The invention claimed herein is new and novel in accordance with 35 U.S.C. § 102 and satisfies the conditions for patentability in § 102. The invention claimed herein is not obvious in accordance with 35 U.S.C. § 103 and satisfies the conditions for patentability in § 103. This specification and the claims that follow are in accordance with all of the requirements of 35 U.S.C. § 112.

What is claimed is:

1. A method for recovering coal from a mixture containing fine particles of coal, the mixture including fine coal particles, water, and impurities, the method comprising feeding the mixture to a first liquid/solid separator that removes from the mixture pieces of material exceeding a specified lower size limit from the mixture and produces a first stream containing water, impurities, and recoverable fine coal particles, and pumping the first stream from the first liquid/solid separator to at least one second liquid/solid separator, the at least one second liquid solid separator separating recoverable fine coal particles from the first stream producing a product flow containing fine coal particles and a discharge stream containing water and impurities, the fine coal particles in the product flow having a largest dimension of less than 100 microns and a largest dimension of at least 38 microns.

2. The method of claim 1 further comprising conveying the product flow to a dryer and producing with the dryer dried recovered fine coal particles.

3. The method of claim 2 further comprising pelletizing the recovered fine coal particles to form useful coal pellets.

4. The method of claim 3 further comprising adding gross coal pieces to the recovered fine coal particles and forming pellets containing gross coal pieces and recovered fine coal particles.

5. Pellets made by the method of claim 3.

6. Recovered fine coal particles produced by the method of claim 2.

7. The method of claim 1 further comprising flowing the discharge stream from the at least one second liquid/solid separator to at least one third liquid/solid separator and therein separating recoverable fine coal particles from the discharge stream producing a third stream with recoverable fine coal particles therein.

8. The method of claim 7 further comprising flowing the third stream to at least one fourth liquid/solid separator producing a fourth stream with recoverable fine coal particles therein, and then conveying the fourth stream to a dryer and producing with the dryer recovered fine coal particles.

9. The method of claim 1 further comprising, prior to pumping the first stream to the at least one second liquid/solid separator, flowing the first stream to at least one auxiliary liquid/solid separator producing a stream with recoverable fine coal particles therein and a stream for discharge to a collection tank.

10. The method of claim 1 wherein the first liquid/solid separator removes pieces of material from the mixture that have a largest dimension of at least ⅜ inch.

11. The method of claim 1 wherein the first liquid/solid separator includes a downwardly inclined separator screen assembly with at least one screen over which the mixture flows so that pieces of material in the mixture with a largest dimension larger than a size of openings in the at least one screen are segregated on a top surface of screen and therby prevented from flowing to the at least one second separator.

12. The method of claim 11 wherein the at least one screen has separate upper and lower sections each of which is separately adjustable with respect to vertical.

13. The method of claim 1 wherein the at least one second liquid/solid separator is a vibratory screen shaker apparatus.

14. The method of claim 7 wherein the at least one third liquid/solid separator is a hydrocyclone.

15. The method of claim 8 wherein the at least one fourth liquid/solid separator is a centrifuge.

16. The method of claim 9 wherein the at least one auxiliary liquid/solid separator is a hydrocyclone.

17. The method of claim 9 wherein the at least one auxiliary liquid/solid separator is a plurality of auxiliary separators including a first and second auxiliary separator and the at least one second liquid/solid separator is a plurality of second liquid/solid separators including primary and secondary second liquid/solid separators, the method further comprising producing a first coal-rich stream with the first auxiliary separator from the first stream from the first liquid/solid separator, feeding the first coal-rich stream to the primary second liquid/solid separator and producing therewith a flow of recoverable fine coal particles and a first discharge flow containing water, impurities, and recoverable fine coal particles, and feeding the first discharge flow to the second auxiliary separator producing therewith a second coal-rich stream that flows to the secondary second liquid/solid separator and producing therewith a flow of recoverable fine coal particles and a second discharge flow containing water, impurities, and recoverable fine coal particles.

18. A method for recovering coal from a mixture containing fine particles of coal, the mixture including fine coal particles, water, and impurities, the method comprising feeding the mixture to a first liquid/solid separator that removes from the mixture pieces of material exceeding a specified lower size limit from the mixture and produces a first stream containing water, impurities, and recoverable fine coal particles, flowing the first stream to at least one auxiliary liquid/solid separator producing an auxiliary stream with recoverable fine coal particles therein and a stream for discharge to a collection tank, the at least one auxiliary liquid/solid separator being a hydrocyclone, pumping the auxiliary stream from the at least one auxiliary separator with recoverable fine coal particles therein to at least one second liquid/solid separator, the at least one second liquid/solid separator being a vibratory screen shaker apparatus, separating with the at least one second liquid solid separator recoverable fine coal particles from the auxiliary stream producing a product flow containing fine coal particles and a discharge stream containing water and impurities, the fine coal particles in the product flow having a largest dimension of less than 100 microns and a largest dimension of at least 38 microns, and conveying the product flow to a dryer and producing with the dryer dried recovered fine coal particles.

* * * * *

UNITED STATES PATENT AND TRADEMARK OFFICE

CERTIFICATE OF CORRECTION

PATENT NO. : 6,156,083
DATED : December 5, 2000
INVENTOR(S) : James R. Dial

It is certified that error appears in the above-identified patent and that said Letters Patent is hereby corrected as shown below:

Title page,
Assignee: line 1, after "Tuboscope" insert -- I/P --.

Claim 1, column 8,
Line 25, between "liquid" and "solid" insert --/--.

Signed and Sealed this

Twenty-fifth Day of September, 2001

*Attest:*

Nicholas P. Godici

NICHOLAS P. GODICI
*Acting Director of the United States Patent and Trademark Office*

*Attesting Officer*